United States Patent [19]

Ogawa et al.

[11] Patent Number: 4,784,289

[45] Date of Patent: Nov. 15, 1988

[54] TICKET ISSUING DEVICE FOR A TICKET MACHINE

[75] Inventors: Izumi Ogawa; Keisuke Murakami; Mamoru Tago; Chihiro Aoki; Tsutomu Fujiwara; Susumu Matsuda, all of Shizuoka, Japan

[73] Assignee: Tokyo Electric Co., Ltd., Tokyo, Japan

[21] Appl. No.: 928,007

[22] Filed: Nov. 7, 1986

[30] Foreign Application Priority Data

| | | | |
|---|---|---|---|
| Nov. 13, 1985 | [JP] | Japan | 60-254217 |
| Nov. 13, 1985 | [JP] | Japan | 60-254218 |
| Feb. 10, 1986 | [JP] | Japan | 61-27439 |

[51] Int. Cl.[4] ..... B65H 5/02; B65H 43/08

[52] U.S. Cl. ..... 221/9; 221/21; 271/213; 414/36

[58] Field of Search ..... 221/9, 13, 21; 235/379, 235/380; 271/146, 176, 180, 210, 213, 215, 221, 198, 296, 297, 302, 303, 304, 902; 194/206, 207; 414/36, 113

[56] References Cited

U.S. PATENT DOCUMENTS

| | | | |
|---|---|---|---|
| 3,765,523 | 10/1973 | Nakanishi | 194/207 X |
| 3,836,980 | 9/1974 | Grosswiller et al. | 235/379 X |
| 4,319,132 | 3/1982 | Guibord et al. | 194/206 X |
| 4,381,445 | 4/1983 | Jenkins et al. | 235/379 |
| 4,450,978 | 5/1984 | Graef et al. | 221/21 X |
| 4,462,506 | 7/1984 | Ohba | 221/21 X |

FOREIGN PATENT DOCUMENTS

| | | |
|---|---|---|
| 604293 | 9/1978 | Switzerland . |
| 1164944 | 9/1969 | United Kingdom . |
| 1457853 | 12/1976 | United Kingdom . |
| 2090454 | 7/1982 | United Kingdom . |
| 2137393 | 10/1984 | United Kingdom . |

*Primary Examiner*—F. J. Bartuska

*Attorney, Agent, or Firm*—Oblon, Fisher, Spivak, McClelland, & Maier

[57] ABSTRACT

A ticket issuing device for a ticket machine according to the present invention comprises a holding plate for receiving thereon tickets fed one by one from a data writing station by a feeding mechanism and for temporarily holding the tickets in a layered condition thereon, a receiving plate located adjacent a ticket issuing port, and an operating member for discharging tickets on the holding plate onto the receiving plate when an issuing signal is issued. Thus, a plurality of tickets can be discharged at a time onto the receiving plate, thereby giving facilities to a person who tries to receive the tickets. The device further comprises a transferrer constituted by electromagnets, the holding plates, and a mechanism interconnecting them which operates when an issue stopping signal is issued to transfer tickets on the holding plate toward a storage. Thus, tickets to be withdrawn are automatically transferred into the storage, thereby giving facilities to a withdrawing person.

16 Claims, 10 Drawing Sheets

TICKET ISSUING DEVICE FOR A TICKET MACHINE

BACKGROUND OF THE INVENTION

1. Field of the Invention

This invention relates to a ticket machine for printing particular matters on a ticket and issuing it, and more particularly to a ticket issuing device for finally issuing a ticket.

2. Description of the Prior Art

A ticket machine, for example, for handling airline tickets for air planes, is generally constructed such that it receives inputs of data regarding a passenger to whom an airline ticket is to be issued, writes particular data on an airline ticket and simultaneously examines qualification of the passenger, and then automatically issues the ticket. Here, qualification of a passenger may involve qualification of a cash card and checking of the balance of money on deposit of the passenger when the passenger tries to buy a ticket with the cash card, and checking of whether or not the passenger itself is listed as a radical activist. If such examination of qualification of the passenger finds out that the passenger comes under any reason of disqualification, the airline ticket to be issued to the passenger will be withdrawn at an issuing port by a member of the staff.

Meanwhile, airline tickets issued are not always taken by individual people: for example, a leader of a group may take a large number of airline tickets by itself. However, since airline tickets are issued one by one, even a large number of airline tickets must be taken one by one, which is very troublesome to the passenger. It is also a problem that when an airline ticket is to be withdrawn, a member of the staff itself must come around to an issuing port and withdraw the airline ticket, which is troublesome to the member of the staff.

OBJECTS AND SUMMARY OF THE INVENTION

It is a first object of the present invention to provide a ticket issuing device for a ticket machine which can issue a plurality of tickets at a time.

It is a second object of the invention to provide a ticket issuing device for a ticket machine which can automatically withdraw a ticket which must not be issued.

It is a third object of the invention to provide a ticket issuing device for a ticket machine which can automatically withdraw a ticket which has been left for a predetermined fixed time after issuing of it.

It is a fourth object of the invention to provide a ticket issuing device for a ticket machine which can hold a large number of withdrawn tickets in a lined up state.

According to the present invention, a ticket issuing device for a ticket machine comprises a holding plate for receiving thereon tickets fed one by one from a data writing station by a feeding mechanism and for temporarily holding the tickets in a layered condition thereon, a receiving plate located adjacent a ticket issuing port, an operating member operable in response to an issuing signal for discharging tickets on the holding plate onto the receiving plate, and a transferring means operable in response to an issue stopping signal for transferring tickets on the holding plate toward a storage. Accordingly, tickets are fed one by one to the ticket issuing device and accumulated in layers on the holding plate.

When a predetermined number of tickets are thus accumulated, an issuing signal is issued and the operating member operates to issue the tickets at a time onto the receiving plate. Meanwhile, if an issue stopping signal is developed before issuing of the tickets, the transferring means operates to transfer the tickets on the holding plate toward the storage.

A more complete appreciation of the invention and many of the attendant advantages thereof will be readily obtained as the same becomes better understood by reference to the following detailed description when considered in connection with the accompanying drawings, wherein:

DESCRIPTION OF THE PREFERRED EMBODIMENT

Figure 1:
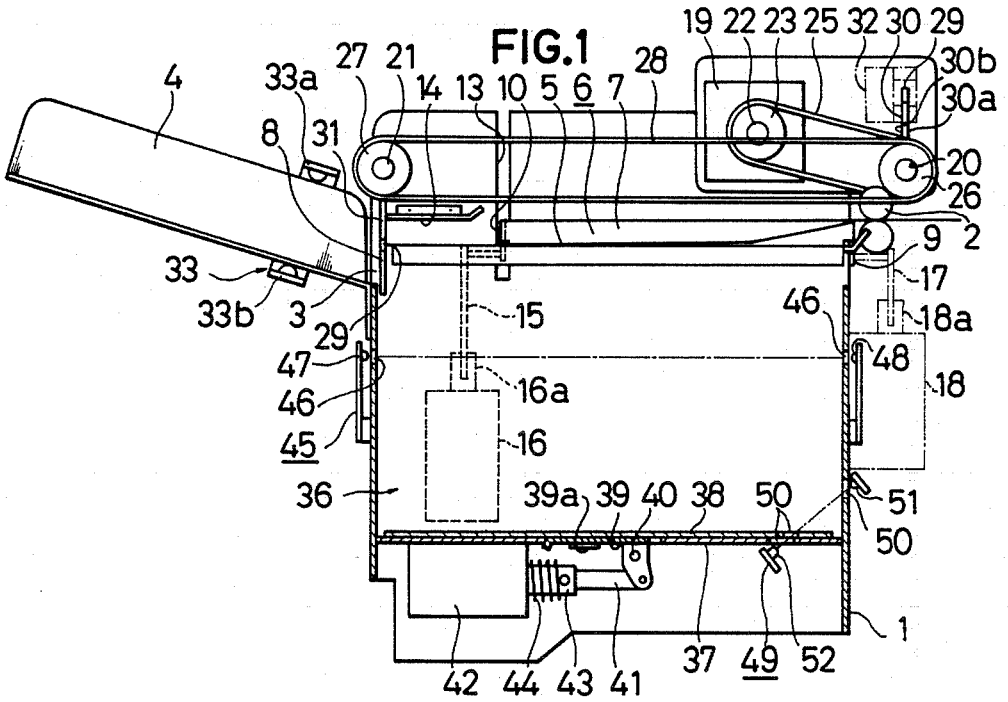
FIG. 1 is a vertical sectional, side elevational view of a ticket issuing device illustrating an embodiment of the present invention.
Figure 2:
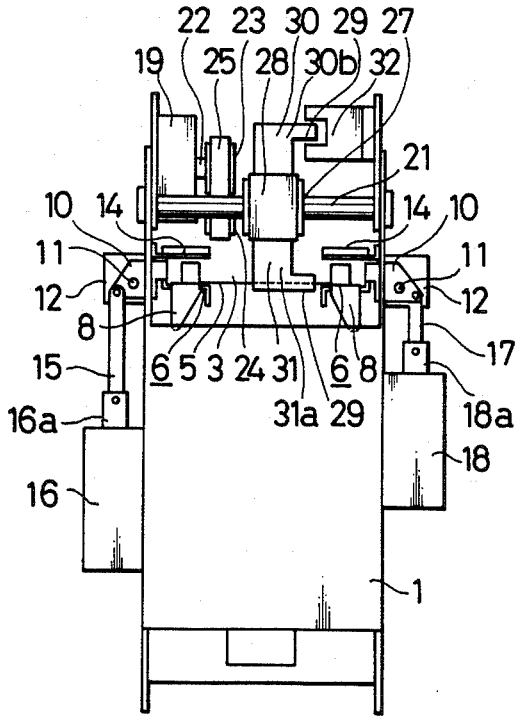
FIG. 2 is a front elevational view of the ticket issuing device of FIG. 1 as viewed from its ticket issuing port side.
Figure 3:
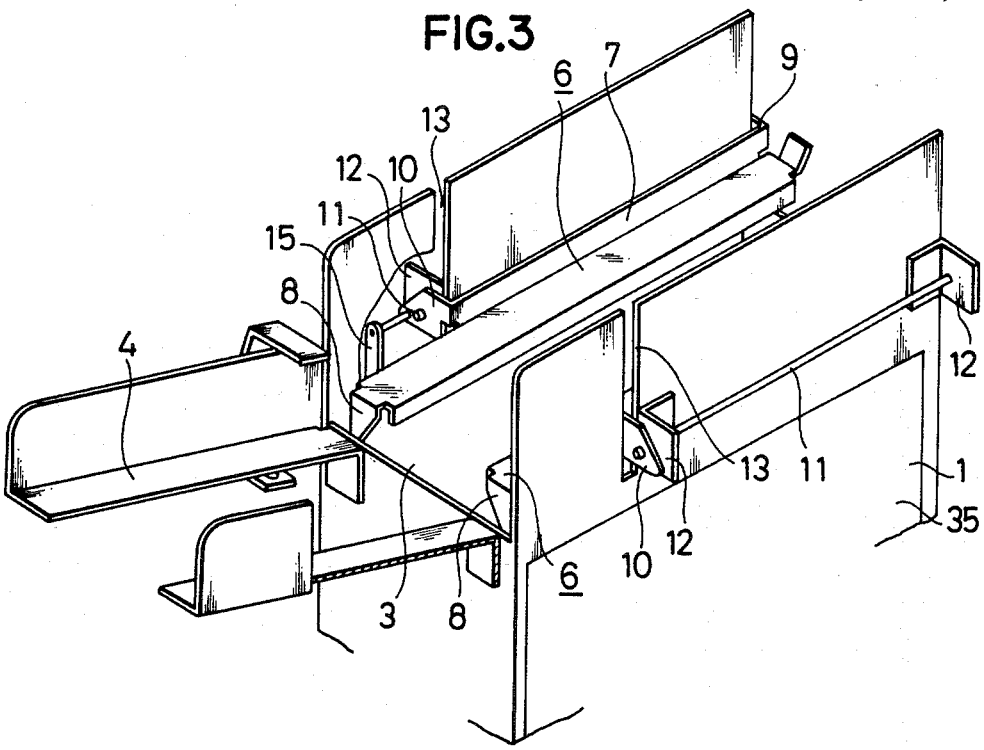
FIG. 3 is a perspective view showing a mounting structure for a holding plate.

An embodiment of the present invention will be described with reference to FIGS. 1 to 10(*d*). The embodiment is constituted as a ticket issuing device installed in an airport for issuing airline tickets. The ticket issuing device includes a box-shaped stocker 1. A feed roller 2 is located at an end of a top portion of the stocker 1 and serves as a feeding mechanism connected to a driving means not shown.

A ticket issuing port 3 is formed at the other end of a top portion of the stocker 1, and a pair of receiving plates 4 are secured adjacent the ticket issuing port 3 and extend in a downwardly inclined relationship from the outside to the inside. A detector 33 is provided for one of the receiving plates 4 and includes a light emitting element 33*a* having an optical axis directed substantially in a vertical direction, and a light receiving element 33*b*.

The ticket issuing device further includes a pair of elongated holding plates 6 mounted at upper part of the stocker 1 for supporting thereon opposite sides of a ticket 5, that is, an airline ticket. Each of the holding plates 6 has integrally formed thereon a guide wall 7 for guiding a side edge of a ticket 5, a stopper 8 for interfering with an extension wall of the bottom of a receiving plate 4, and a pair of small bent projections 9, 10 at opposite ends of the guide wall 7. The stocker 1 has a pair of slots 13 formed in opposite side walls thereof for allowing the small projections 10 to extend outwardly therethrough. Thus, the small projections 10, 9 extend outwardly through the grooves 13 and from one end of the side walls of the stocker 1 and are supported for pivotal motion of a pair of shafts 11 mounted on support brackets 12 secured to the stocker 1. The small projection 10 of the holding plate 6 on one side is connected via a link 15 to a plunger 16a of an electromagnet 16 which serves as an actuating means while the small projection 9 of the holding plate 6 on the opposite side is connected via a link 17 to a plunger 18*a* of an electromagnet 18 which also serves as an actuating means. Here, a transferring means is constituted by the electromagnets 16, 18, the holding plates 6, and a mechanism interconnecting them. A pair of guide plates 14 are mounted on inner faces of the opposite side walls of the stocker 1 in an opposing relationship to and above upper faces of end portions of the holding plates 6.

A stepping motor 19 and a pair of rotatable shafts 20, 21 are mounted at upper part of the stocker 1, and a belt 25 extends between and around a pulley 23 secured to a rotary shaft 22 of the stepping motor 19 and another pulley 24 secured to the shaft 20. A belt 28 in the form of an endless belt extends between and around a further pair of pulleys 26, 27 secured to mid portions of the shafts 20, 21, respectively, and a pair of projecting members 30, 31 each having a sidewardly extended light intercepting piece 29 thereon are secured to an outer periphery of the belt 28 in an equidistantly spaced relationship from each other. The projecting members 30, 31 each have a pushing out surface 30*a*, 31*a* on one face thereof and an abutting surface 30*b*, 31*b* on the other face thereof. Here, an operating member is constituted by the belt 28 and the actuating mechanism therefor, and the projecting members 30, 31. In addition, a detector 32 is secured to an inner side face of an upper portion of the stocker 1 and has an optical axis located to be intercepted by the light intercepting pieces 29.

A storage 36 is formed in the interior of the stocker 1 and is opened and closed by a door 35 having a lock. A movable plate 38 is placed on a bottom wall 37 of the storage 36, and a pressing plate 39 is mounted for pivotal motion around a shaft 40 and supports the movable plate 38 thereon. The pressing plate 39 is connected to a plunger 43 of an electromagnet 42 via a link 41. The pressing plate 39 is urged downwardly by a spring 44 for returning the plunger 43 and is normally positioned within a same plane with the bottom wall 37 by means of a stopper 39*a*.

A detector 45 for detecting a ticket 5 is located at a vertical position on the stocker 1 spaced by a predetermined distance from the bottom wall 37. The detector 45 includes a light emitting element 47 and a light receiving element 48 located in an opposing relationship through holes 46 formed in front and rear walls of the stocker 1.

Another detector 49 for detecting a ticket 5 on the movable plate 38 is also provided on the stocker 1. The detector 49 includes a light emitting element 51 and a light receiving element 52 located in an opposing relationship through holes 50 formed in the rear wall and the bottom wall 37 of the stocker 1 and also in the movable plate 38.

Electric connections of the ticket issuing device will now be described. The ticket issuing device includes a CPU (central processing unit) 54 connected to a host computer 53. A keyboard 55, a ROM (read-only memory) 56, and a RAM (random access memory) 60 including a first timer 57, a second timer 58 and a counter 59 are connected to the CPU 54. The detectors 32, 33, 45, 49 are also connected to the CPU 54, and in addition the electromagnets 16, 18, the stepping motor 19 and the electromagnet 42 are connected to the CPU 54 via a first driver 61, a second driver 62 and a third driver 63, respectively.

Figure 6:
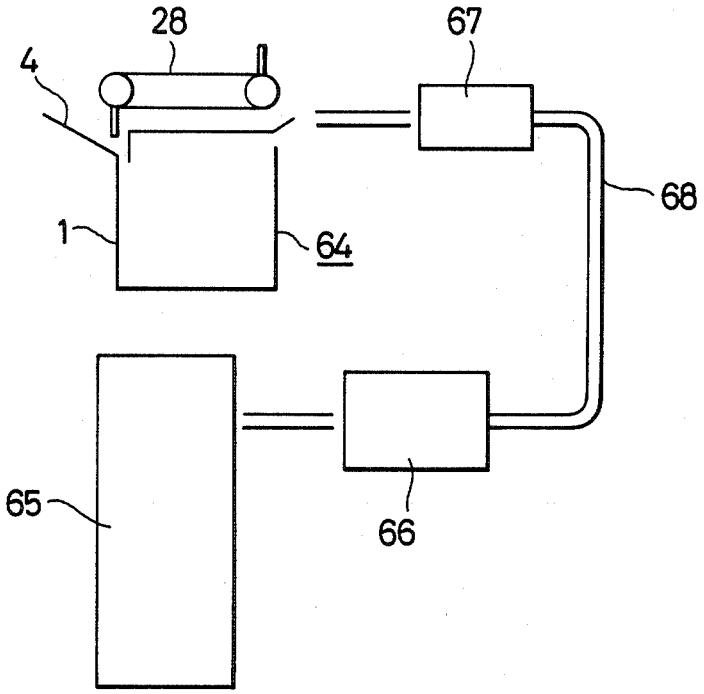
FIG. 6 is a diagrammatic representation showing a layout of a paper supply device, an encoder, a printing station and the storage.

The ticket issuing device 64 has such a construction as described above. As shown in FIG. 6, a paper supply device 65 for receiving a large number of tickets 5 accumulated in layers thereon and for supplying the tickets 5 one by one therefrom, an encoder 66, a printing means 67 constituting a data writing station and the ticket issuing device 64 are arranged along, and interconnected by, a transporting path 68 in an order as listed here.

Figure 7A:
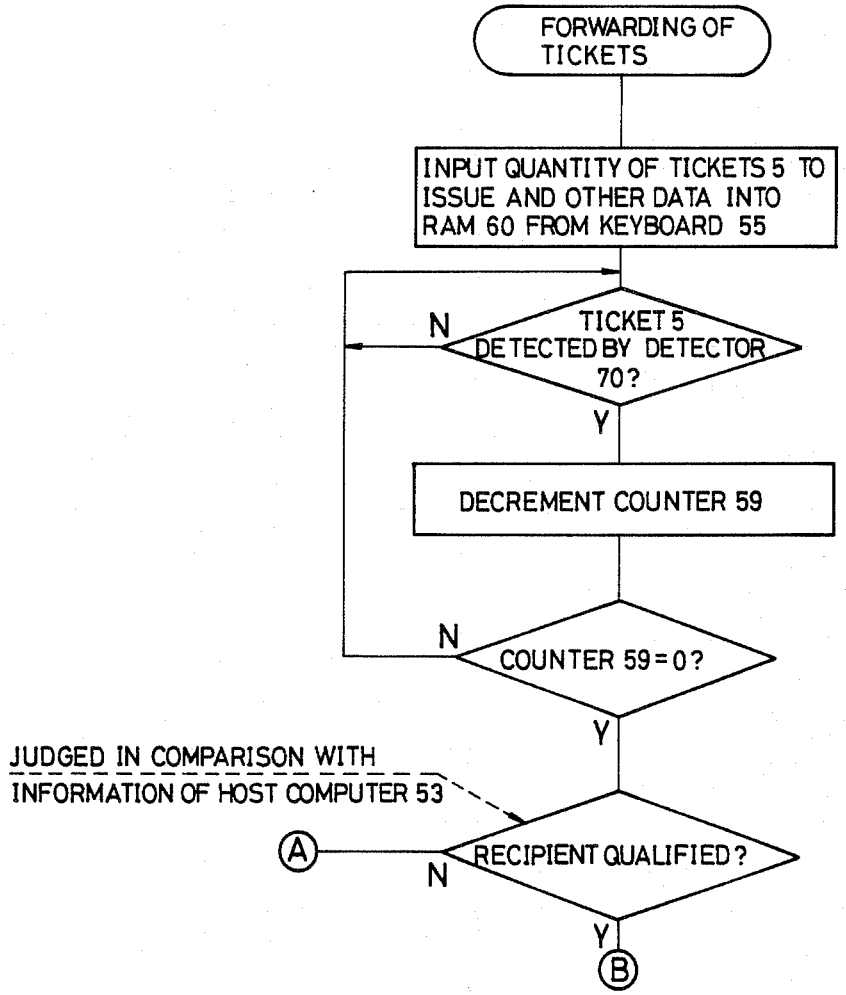
FIGS. 7(*a*) and 7(*b*) are a flow chart showing a flow of operations of the ticket issuing device of FIG. 1.
Figure 7B:
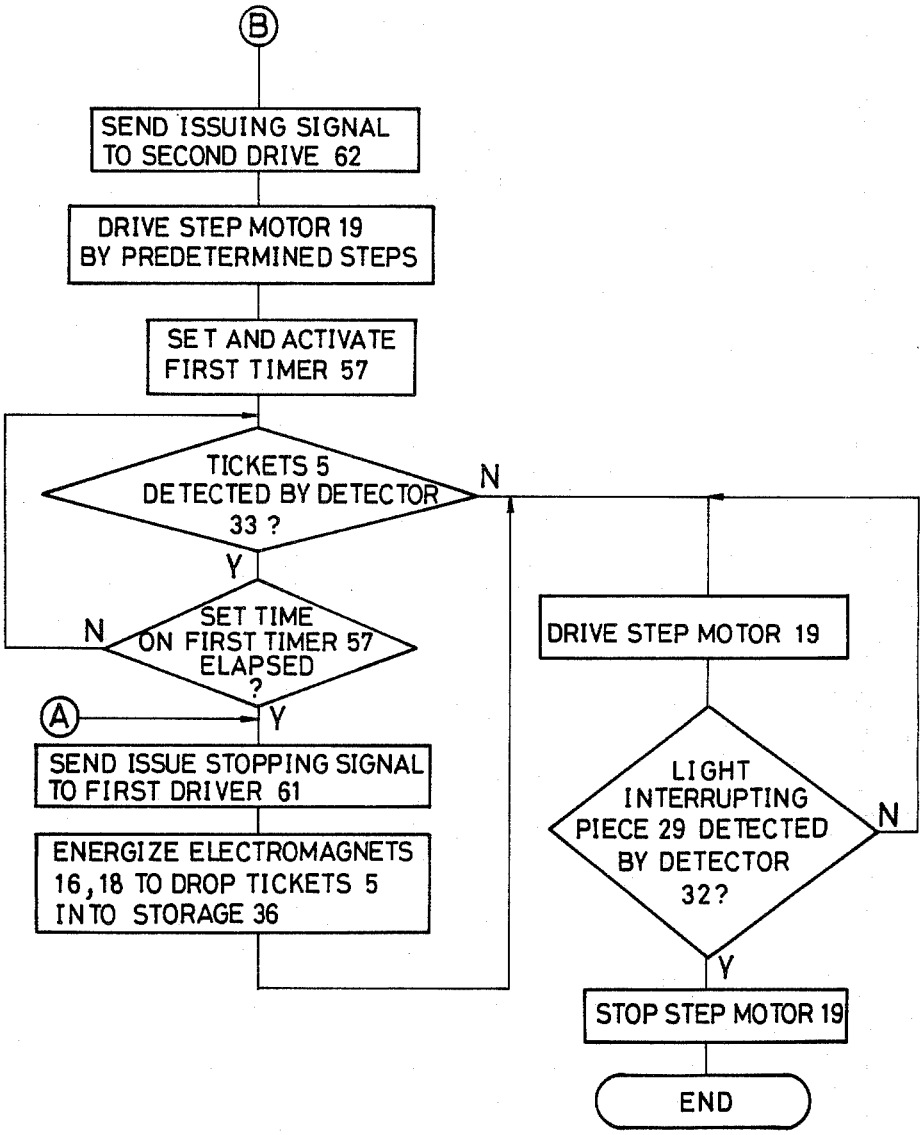
Figure 8:
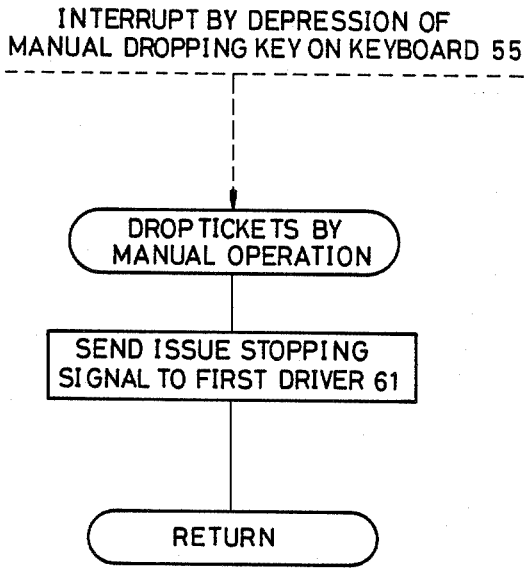
FIG. 8 is a flow chart showing details of an interrupt processing.
Figure 10:
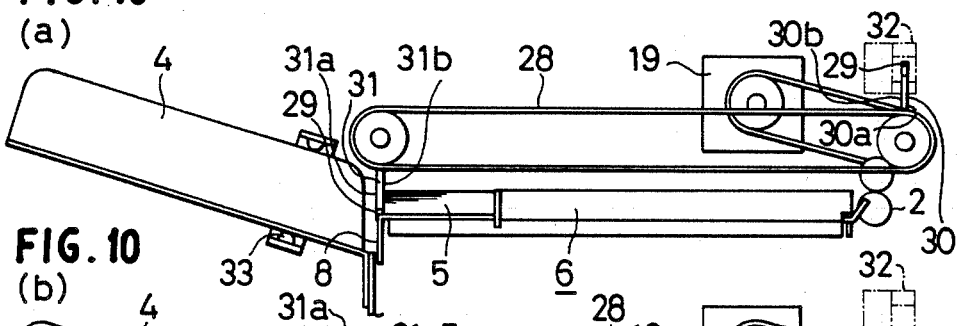
FIGS. 10(*a*), 10(*b*), 10(*c*) and 10(*d*) are side elevational views illustrating successive steps of a ticket issuing operation.
Figure 10:
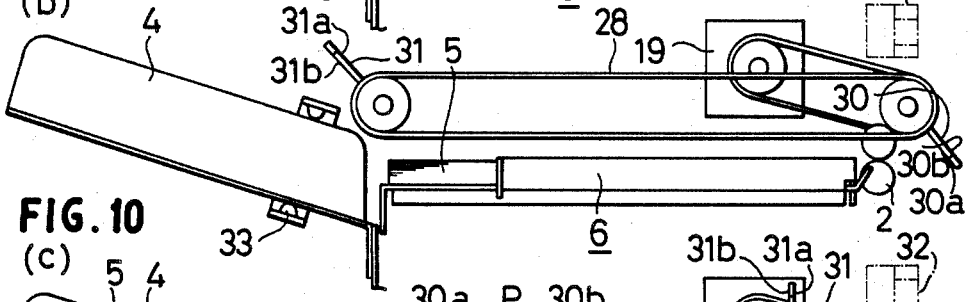
Figure 10:
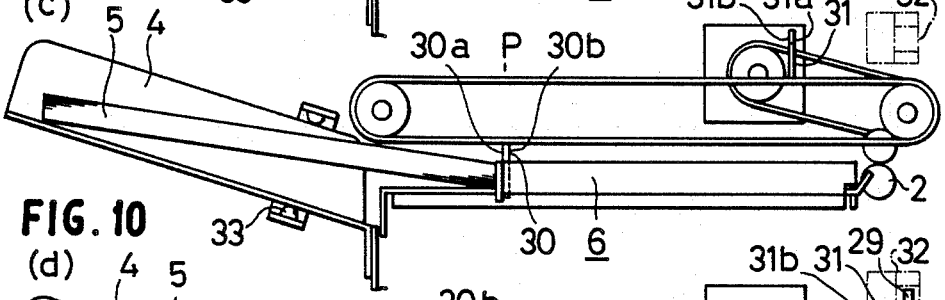
Figure 10:
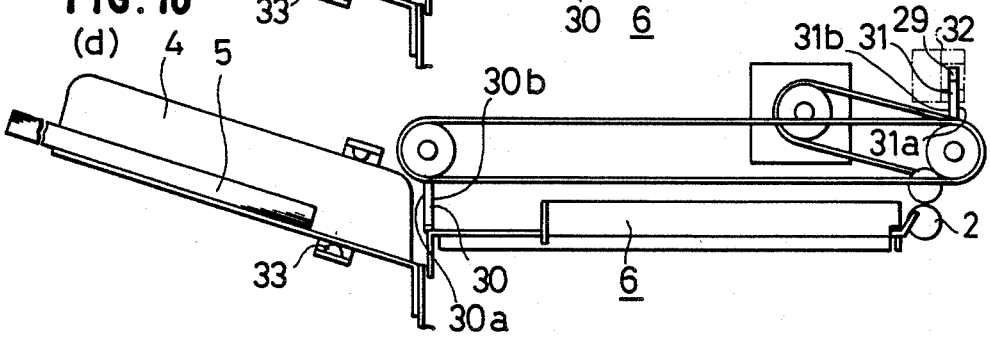

In such a construction, a flow of operation will be described with reference to a flow chart of FIGS. 7(*a*) and 7(*b*). At first, when a ticket 5, that is, an airline ticket, is to be sold, a purchaser will be inquired of its destination, the departure time and the number of tickets to be issued, and such data will be inputted to the RAM 60. Particularly, the number of tickets to be issued to set to the counter 59 within the RAM 60. Consequently, the specified number of tickets 5 are supplied one by one from the paper supply device 65, and at the encoder 66, contents of magnetic stripes formed on the tickets 5 are read out or predetermined data are written on such magnetic stripes of the tickets 5, and then at the printing means 67, the input data are printed on the tickets 5. Then, the tickets 5 are fed one by one from the printing means 67 to the stocker 1 and thus placed one by one on the holding plates 6 with forward ends thereof aligned by the abutting faces 31*b* of the projecting members 31 as shown in FIG. 10(*a*). As the tickets 5 are thus fed to the holding plates 6, they are detected by an additional detector 70 located forwardly of the feed roller 2, and each time a ticket 5 is detected by the detector 70, the value of the counter 59 is decremented by one. Thus, reduction of the value of the counter 59 to zero indicates that the preset number for tickets 5 to be accumulated on the holding plates 6 is reached. Then, normally the tickets 5 on the holding plates 6 will be issued at once. Meanwhile, qualification of the purchaser is examined. For example, in case the purchaser tries to buy the tickets 5 with a cash card, qualification of the cash card and the balance of money on deposit are examined. Thus, requirements of a qualified purchaser are that the cash card is valid and effective and the balance of money on deposit exists and that the purchaser is not a radical activist.

Then, when the purchaser meets the requirements of a qualified purchaser, an issuing signal is applied to the second driver 62. Consequently, the stepping motor 19 is rotated by a predetermined number of steps so that, after going through a condition shown in FIG. 10(*b*), the pushing out surface 30a of the projecting member 30 will push rear edges of the tickets 5 to move the tickets 5 until the projecting member 30 reaches a fixed position P as shown in FIG. 10(*c*). Meanwhile, the first timer 57 is set simultaneously with activation of the stepping motor 19, and the detector 33 will detect the presence of the tickets 5 thus pushed out onto the receiving plates 4 and develop an ON signal. The ON signal of the detector 33 is changed over to an OFF signal upon removal of the tickets 5 on the receiving plates 4. However, if the detector 33 is switched off before the preset time to the first timer 57 elapses, the motor 19 will be activated again. Consequently, the belt 28 will be circulated to move the projecting pieces 30, 31 thereon in a clockwise direction as shown in FIG. 10(*d*). Then, at a point of time when the light intercepting piece 29 of the projecting member 31 is detected by the detector 32, the stepping motor 19 is stopped. The stopping position here corresponds to a position at which the abutting surface 30*b* of the projecting member 30 will align forward ends of tickets 5 to be subsequently fed thereto to a fixed position and thus defines home positions of the projecting members 30, 31. In this manner, a plurality of tickets 5 can be issued at a time, which is convenient to a purchaser who wants to receive such a plurality of tickets 5. Meanwhile, if tickets 5 on the receiving plates 4 fail to be received by a purchaser, they may slip on the receiving plates 4 toward the ticket issuing port 3, but they will be abutted with the stoppers 8 of the holding plates 6 and thus prevented from dropping into the storage 36.

Figure 11:
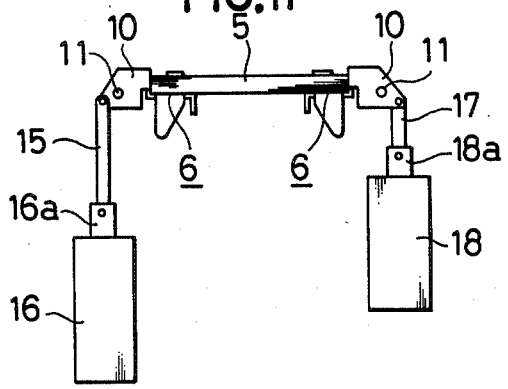
FIG. 11 is a front elevational view showing the holding plate on which tickets are accumulated in layers.
Figure 12:
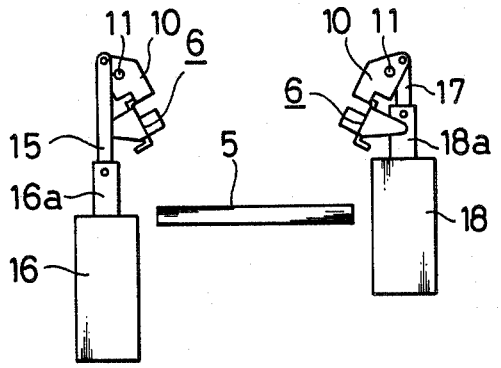
FIG. 12 is a similar view by showing the holding plate pivoted downwardly from the position of FIG. 11.

On the contrary, if the puchaser of the tickets 5 does not meet the requirements of a qualified puchaser, then an issue stopping signal is delivered to the first driver 61. Consequently, the electromagnets 16, 18 are energized to pivot the holding plates 6 from a position as shown in FIG. 11 to another position as shown in FIG. 12 around the respective shafts 11. As a result, the tickets 5 on the holding plates 6 will drop into the storage 36.

Delivery of an issue stopping signal to the first driver 61 is not limited to a case wherein a purchaser of tickets 5 does not meet requirements of a qualified purchaser. Even where a purchaser of tickets 5 meets the requirements of a qualified puchaser, an issue stopping signal is developed if tickets 5 have not yet been received by the puchaser when a preset time to the first timer 57 elapses after the tickets 5 were issued onto the receiving plate 4. Consequently, the tickets 5 which have been held by the holding plates 6 and the receiving plate 4 in a condition as shown in FIG. 10(*c*) now drop into the storage 36. thereby preventing a possible accident that the tickets 5 issued and left on the receiving plates 4 may be taken away by a third party. It is to be noted that even where tickets 5 are supported by the stoppers 8, if the holding plates 6 are pivoted downwardly, then they will drop into the storage 36 because also the stoppers 8 will be retracted sidewardly.

An issue stopping signal may be delivered to the first driver 61 also by arbitrary operation by an operator of the ticket issuing device 64. In particular, an operator can at any time develop an issue stopping signal to the first driver 61 as an interrupt processing as shown by a flow chart in FIG. 8 by operating a manual dropping key not shown on the keyboard 55. Accordingly, an operator can drop a ticket 5 at any location within the stocker 1 into the storage 36.

Once a ticket 5 has been dropped into the storage 36, a third party cannot take it out arbitrarily. When such tickets 5 are to be disposed of, a responsible person will unlock the lock and open the door 35.

Figure 4:
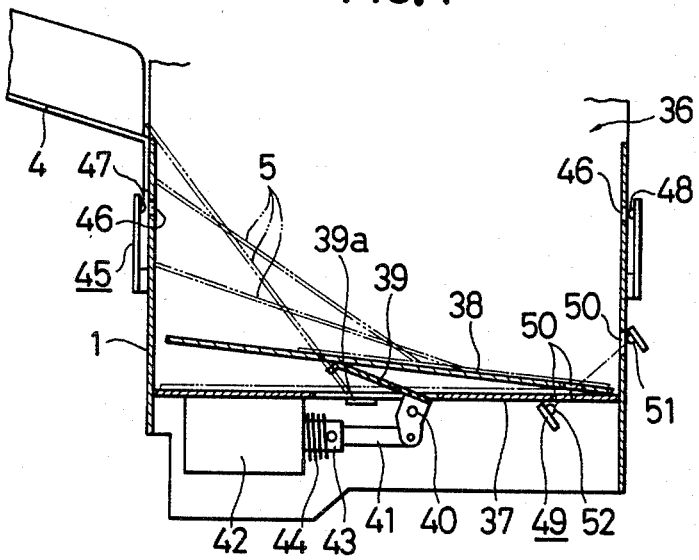
FIG. 4 is a vertical sectional, side elevational view illustrating operation of a movable plate within a storage.
Figure 5:
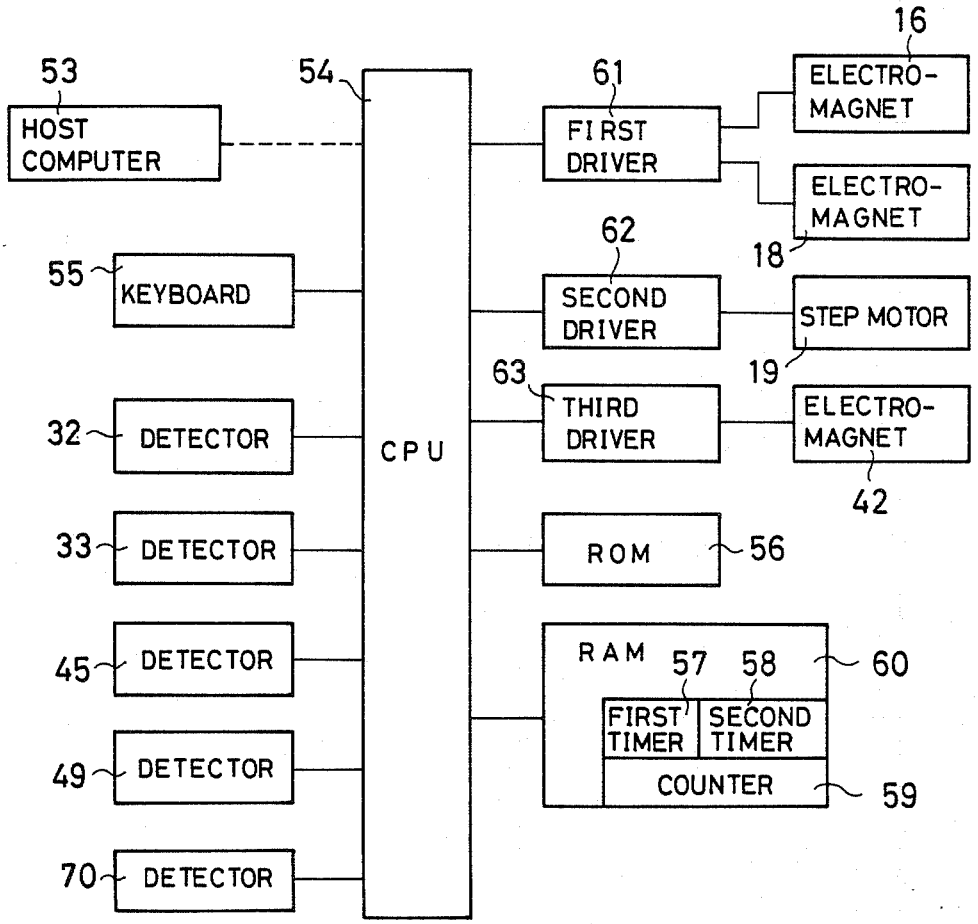
FIG. 5 is a block diagram of the ticket issuing device of FIG. 1.

As described above, tickets 5 within the stocker 1 are dropped into the storage 36 at need. In this instance, the tickets 5 will drop in an inclined orientation as shown in FIG. 4. Accordingly, they may be held in an inclined orientation and hence succeeding tickets 5 may follow the preceding tickets 5 and thus be inclined thereby. In the present embodiment, such inclined tickets 5 are rearranged so as to assume a horizontal orientation or position. In particular, when a ticket 5 drops, the optical axis of the detector 15 is intercepted by the ticket 5 so that the detector 45 is switched on. When the on state of the detector 45 continues for one second, it is judged either that the ticket 5 is in its inclined position or that a predetermined number of tickets 5 are accumulated in the storage 36. One of the two alternative judgments is determined by comparison between a detection signal of the detector 45 and an output of a counter not shown which counts the number of tickets 5 dropped into the storage 36.

Figure 9:
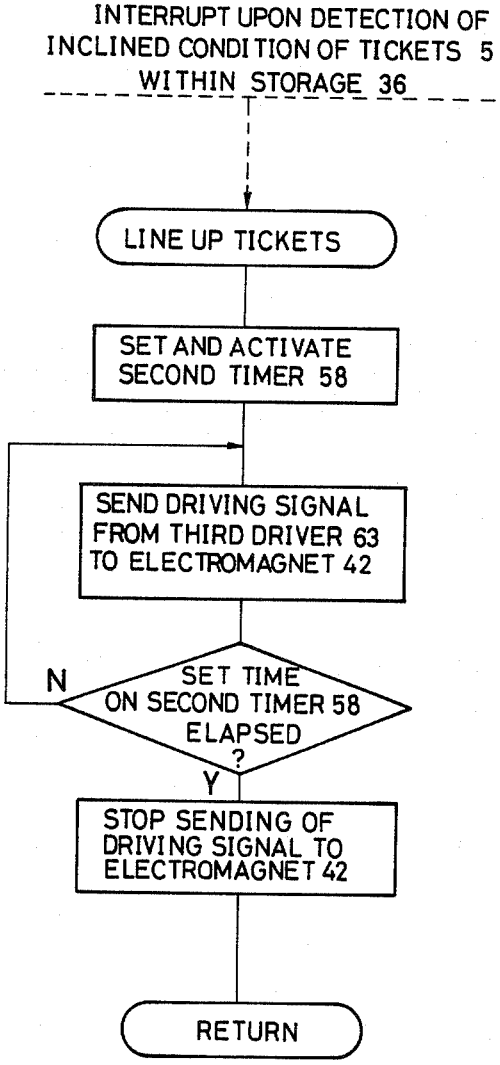
FIG. 9 is a flow chart showing details of another interrupt processing.

In case it is judged that the ticket 5 is in its inclined position, a processing for rearranging the ticket 5 is executed as an interrupt processing as shown in FIG. 9. In particular, the second timer 58 within the RAM 60 is switched on, and an actuating signal is delivered from the third driver 63 to the electromagnet 42. Consequently, the plunger 43 of the electromagnet 42 is retracted to pivot the pressing plate 39 around the shaft 40. As a result, the movable plate 38 is pushed at a portion spaced from the center thereof to rise in an inclined condition to gradually rearrange the inclined ticket 5 within the storage 36 into its horizontal position. Then, as a predetermined time elapses, the second timer 58 stops its operation, and at the same time delivery of the actuating signal to the electromagnet 42 is stopped. Accordingly, tickets 5 within the storage 36 can be accumulated in layers in horizontal positions. It is to be noted that, in the present embodiment, due to its construction wherein the movable plate 38 normally disposed in a horizontal position is raised to correct the posture of tickets 5, the height of the storage 36 can be reduced as compared with an alternative arrangement in which the bottom wall 37 is mounted in an inclined relationship. Accordingly, the overall height of the entire ticket issuing device 64 can be controlled, which contributes to reduction in size of the ticket issuing device 64.

Figure 13:
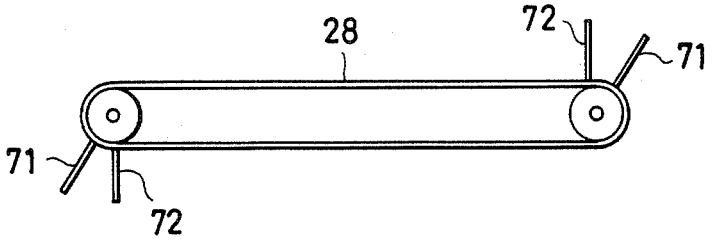
FIG. 13 is a side elevational view showing an operating member in a modified form.

FIG. 13 shows modified forms of the projecting members 30, 31 on the belt 28. In particular, a pair of pushing out projecting members 71 for pushing out tickets 5 toward receiving plates 4 are secured to a belt 28, and another pair of abutting projecting members 72 for abutting with and positioning tickets 5 fed thereto from a feed roller 2 are also secured to the belt 28 adjacent the pushing out projecting members 71. Thus, one of the pushing out projecting members 71 and one of the abutting projecting members 72 in pair correspond to the projecting member 30 or 31 described above.

It will be appreciated that the data writing station is not limited to the printing means 67 and may be of the type wherein data is written by a magnetic head.

What is claimed is:

1. A ticket issuing device for a ticket machine, comprising:

a feeding mechanism for feeding a ticket;

a holding plate for receiving a ticket fed thereto one at a time by said feeding mechanism and for temporarily holding a plurality of received tickets in a layerable condition thereon;

a receiving plate located adjacent an end of said holding plate opposite to said feeding mechanism;

an operating member operable in response to an issuing signal for pushing out at once said plurality of tickets accumulated on said holding plate to said receiving plate;

a storage for storing tickets therein; and a transferring means operable in response to an issue stopping signal for directly transferring into said storage tickets accumulated on said holding plate.

2. A ticket issuing device according to claim 1, wherein said operating member includes:

an endless belt for circulating along an upper face of said holding plate;

a projecting member secured to said endless belt; and a pushing out surface formed on one face of said projecting member for pushing out tickets on said holding plate toward said receiving plate.

3. A ticket issuing device according to claim 2, wherein said endless belt has a plurality of such projecting members secured thereto in an equidistantly spaced relationship from each other.

4. A ticket issuing device according to claim 2, wherein said endless belt has a plurality of projecting members secured thereto in an equidistantly spaced relationship from each other, said projecting members each having on its face opposite to the pushing out surface an abutting surface for abutting with and positioning tickets on said holding plate.

5. A ticket issuing device according to claim 2, wherein said endless belt has a plurality of such projecting members secured thereto in an equidistantly spaced relationship from each other, said projecting members each having on its face opposite to the pushing out surface an abutting surface for abutting with and positioning tickets on said holding plate, said ticket issuing device further comprising a detector for detecting one of said projecting members, whereby said projecting members are located such that when one of said projecting members is detected by said detector, the abutting surface of another one of said projecting members may position tickets on said holding plate.

6. A ticket issuing device according to claim 1, wherein said operating member includes:

an endless belt for circulating along an upper face of said holding plate;

a pushing out projecting member secured to said endless belt for pushing out tickets on said holding plate toward said receiving plate; and an abutting projecting member secured to said endless belt adjacent said pushing out projecting member for abutting with and positioning tickets on said holding plate.

7. A ticket issuing device according to claim 1, wherein said storage is located just below said holding plate which is composed of a pair of holding members shaped and located to support opposite sides of said plurality of tickets, and said transferring means includes a mechanism for pivoting said holding plate to allow said plurality of tickets on said holding plate to drop toward said storage, and an electromagnet for operating said mechanism for pivoting.

8. A ticket issuing device for a ticket machine, comprising:

a feeding mechanism for feeding a ticket;

a holding plate for receiving a ticket fed thereto one at a time said feeding mechanism and for temporarily holding a plurality of received tickets in a layerable condition thereon;

a storage for storing tickets therein;

a transferring means operable in response to an issue stopping signal for at once directly transferring into said storage said plurality of tickets accumulated on said holding plate;

an endless belt operable in response to an issuing signal for circulating along an upper face of said holding plate; and a projecting member secured to said endless belt and having a pushing out surface for pushing out at once said plurality of tickets accumulated on said holding plate to an end of said holding plate opposite to said feeding mechanism.

9. A ticket issuing device according to claim 8, wherein said endless belt has a plurality of such projecting members secured thereto in an equidistantly spaced relationship from each other.

10. A ticket issuing device according to claim 8, wherein said endless belt has a plurality of projecting members secured thereto in an equidistantly spaced relationship from each other, said projecting members each having a face opposite to the pushing out surface thereof an abutting surface for abutting with and positioning tickets on said holding plate.

11. A ticket issuing device according to claim 8, further comprising an abutting projecting member secured to said endless belt adjacent the first-mentioned projecting member for abutting with and positioning tickets on said holding plate.

12. A ticket issuing device for a ticket machine comprising:

a feeding mechanism for feeding a ticket;

a holding plate for receiving a ticket fed thereto by said feeding mechanism and for temporarily holding received tickets in a layered condition thereon;

a receiving plate located adjacent an end of said holding plate remote from said feeding mechanism;

an operating member operable in response to an issuing signal for pushing out tickets on said holding plate to said receiving plate;

a storage for storing tickets therein;

a transferring means operable in response to an issue stopping signal for transferring tickets on said holding plate into said storage; and wherein said storage is located just below said holding plate and said receiving plate is inclined downwardly toward said storage; and said holding plate has a stopper formed thereon for stopping circulation of a ticket between said receiving plate and said storage; while said transferring means is constructed to open said holding plate together with said stopper to allow tickets held on said holding plate or on said receiving plate to drop toward said storage.

13. A ticket issuing device according to claim 12, further comprising a movable plate mounted for rising movement from a horizontal position on the bottom of said storage, and an actuating means for actuating said movable plate to rise.

14. A ticket issuing device according to claim 12, further comprising a movable plate mounted for rising movement from a horizontal position on the bottom of said storage, an actuating means for actuating said movable plate to rise, and a detector for detecting a ticket in an inclined position within said storage, whereby said actuating means is operated in response to a ticket detection signal of said detector.

15. A ticket issuing device for a ticket machine, comprising:

a feeding mechanism for feeding a ticket;

a holding plate for receiving a ticket fed thereto one at a time by said feeding mechanism and for temporarily holding a plurality of received tickets in a layerable condition thereon;

a receiving plate located adjacent an end of said holding plate opposite to said feeding mechanism;

an operating member operable in response to an issuing signal for pushing out said plurality of tickets on said holding plate to said receiving plate;

a storage for storing tickets therein; and a transferring means operable in response to an issue stopping signal for directly transferring tickets on said holding plate into said storage.

16. A ticket issuing device for a ticket machine, comprising:

a feeding mechanism for feeding a ticket;

a holding plate for receiving a ticket fed thereto one at a time by said feeding mechanism and for temporarily holding a plurality of received tickets in a layerable condition thereon;

a storage for storing tickets therein;

a transferring means operable in response to an issue stopping signal for directly transferring said plurality of tickets on said holding plate into said storage;

an endless belt operable in response to an issuing signal for circulating along an upper face of said holding plate; and a projecting member secured to said endless belt and having a pushing out surface for pushing out said plurality of tickets on said holding plate to an end of said holding plate opposite to said feeding mechanism.

* * * * *